US008161989B2

(12) United States Patent
Kuo

(10) Patent No.: US 8,161,989 B2
(45) Date of Patent: Apr. 24, 2012

(54) CONTROL STRUCTURE OF SELF-OPENING/CLOSING UMBRELLA

(76) Inventor: Shih-Shin Kuo, Hsinchu (TW)

( * ) Notice: Subject to any disclaimer, the term of this patent is extended or adjusted under 35 U.S.C. 154(b) by 83 days.

(21) Appl. No.: 12/784,501

(22) Filed: May 21, 2010

(65) Prior Publication Data

US 2011/0284043 A1 Nov. 24, 2011

(51) Int. Cl.
*A45B 25/16* (2006.01)
*A45B 25/14* (2006.01)

(52) U.S. Cl. ..... 135/24; 135/20

(58) Field of Classification Search ..... 135/22, 135/24, 25.1, 25.4, 40
See application file for complete search history.

(56) References Cited

U.S. PATENT DOCUMENTS

| | | | | |
|---|---|---|---|---|
| 5,174,319 | A * | 12/1992 | Chou et al. | 135/20.3 |
| 5,868,151 | A * | 2/1999 | Kuo | 135/24 |
| 5,992,433 | A * | 11/1999 | Chung-Kuang et al. | 135/24 |
| 6,170,498 | B1 * | 1/2001 | Wu | 135/24 |
| 6,176,246 | B1 * | 1/2001 | Lin et al. | 135/24 |
| 6,684,893 | B2 * | 2/2004 | Kuo | 135/24 |
| 7,798,160 | B2 * | 9/2010 | Chen | 135/24 |
| 2009/0133729 | A1 * | 5/2009 | Chong | 135/20.3 |
| 2010/0288317 | A1 * | 11/2010 | Huang | 135/24 |
| 2010/0319739 | A1 * | 12/2010 | Chong | 135/24 |
| 2011/0114142 | A1 * | 5/2011 | Cai | 135/22 |

FOREIGN PATENT DOCUMENTS

| | | | |
|---|---|---|---|
| JP | 2000014420 | A * | 1/2000 |
| WO | WO 2004045327 | A1 * | 6/2004 |

* cited by examiner

*Primary Examiner* — Winnie Yip
(74) *Attorney, Agent, or Firm* — Leong C. Lei

(57) ABSTRACT

A control structure is provided for mounting to a handle of a self-opening/closing umbrella and includes a reversal prevention wheel around which a safety rope is wound and extending through a central shaft of the umbrella with an end fixed to the reversal prevention wheel and an end fixed to a crown. A locking member that includes a pawl bar and an operation bar is arranged above the reversal prevention wheel. When The umbrella is being compressed and closed, the pawl bar engages a toothed surface of the reversal prevention wheel, whereby when errors occur in the closing of the umbrella, reversed rotation of the wheel is prevented by the pawl bar and the safety rope connected to the reversal prevention wheel is prevented from extension so as to prevent the central shaft from undesired extension and instantaneous spring back of the central shaft is also prevented.

3 Claims, 6 Drawing Sheets

CONTROL STRUCTURE OF SELF-OPENING/CLOSING UMBRELLA

TECHNICAL FIELD OF THE INVENTION

The present invention generally relates to an improvement of control structure of self-opening/closing umbrella, which simply employs a combination of a reversal prevention wheel and a locking member to prevent a central shaft of the umbrella from instantaneous spring back as being acted upon by an umbrella opening spring that is in a compressed condition when an erroneous operation occurs in compressing and closing the umbrella, so that a self-opening/closing umbrella with such a structure can significantly improve safety of use and control of the umbrella and the manufacturing costs be substantially reduced.

DESCRIPTION OF THE PRIOR ART

A control structure and operation of a commonly seen self-opening/closing umbrella is illustrated in U.S. Pat. No. 6,684,7893B2. The known control structure is arranged inside a handle of an umbrella and comprises a main body having a hollow interior in which a control loop is received. A control bar is pivoted to the bottom of the control loop at one side thereof. The main board is provided at one side thereof a button that is exposed through an opening defined in a side wall of the umbrella. With such an arrangement, extension and contraction of a central shaft can be controlled. However, a major disadvantage of such a conventional self-opening/closing umbrella may be encountered in the course of depressing the umbrella for closing. This is because closing umbrella requires compression an umbrella opening spring that is received inside the umbrella central shaft. The umbrella opening spring is of quite a strength and spring force, and a user must apply a great force with his or her hands to compress and close the umbrella to complete a locking operation in a single step. If the application of force or the operation is in error, the compressed umbrella opening spring will spring the central shaft back with a great force. This often hurts the hands or other portions of the body of the user. Thus, the use of the known self-opening/closing umbrella is dangerous to some extents.

To cope with such a problem, self-opening/closing umbrella that is safe in operation is available. Examples are given in Taiwan Utility Model No. M358556 and Chinese Patent Application No. 20070009892.1 (Publication No. CN101438877A), both providing improvement over such a problem. The solutions provided by the two patents are effective in eliminating the dangerous situation occurring in the compressing and closing operation of the conventional self-opening/closing umbrella. However, the solutions of these two patents are complicated in the overall construction and components thereof making the manufacturing and assembling difficult and thus raising the manufacturing costs. It is thus desired to make further improvement over the known umbrella.

SUMMARY OF THE INVENTION

The present invention provides a control structure of self-opening/closing umbrella. As shown in FIGS. 1, 2, and 3, the control structure of the present invention is mounted inside a handle 20 of an umbrella and comprises a main body 10, which is hollow in both an upper portion and a lower portion thereof. The upper hollow portion receives therein a control loop 11 that has a bottom surface on one side of which a control bar 12 is pivotally mounted. A pushbutton 13 is provided at one side of the control loop 11 and a spring 111 is arranged at an opposite side of the control loop 11 to provide a spring force for biasing the control loop 11 toward the pushbutton 13. A tongue 112 is formed inside the control loop 11 at the side opposite to the control bar 12. The lower hollow portion of the main body 10 receives and rotatably supports a reversal prevention wheel 14 with a shaft 141. The reversal prevention wheel 14 has a circumference that includes a first half surface forming a toothed surface 142 and a second half surface forming a rope groove 143 that receives a safety rope 145 that has an end fixed to the rope groove 143 and an opposite end extending through the main body 10 to attach to a crown 41 of the umbrella. The reversal prevention wheel 14 has an end surface forming a circular chamber 144 in which a coil spring 146 is received, whereby an inner end of the coil spring 146 is attached to the shaft 141 and an outer end is fixed to an inside surface of the circular chamber 144. The main body 10 has a central portion that is located above the reversal prevention wheel 14 to rotatably support a locking member 15 with a pin 16. The locking member 15 is loaded by a spring 153. The locking member 15 has a lower portion forming a pawl bar 151 that is located above the rotation space of the toothed surface 142 of the reversal prevention wheel 14 and an upper portion forming an operation bar 152 that has a front section forming a surface-inclined upright portion 1521 and extends through the main body 10 to be located inside a first shaft segment 31 of a central shaft unit 30. The inclined surface of the upright portion 1521 forms a curved recess 1522. Further, a pulley 17 is arranged above the rope groove 143 to guide an upper end of the safety rope 145 to extend upward through the central shaft unit 30 for fixing to the crown 41.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
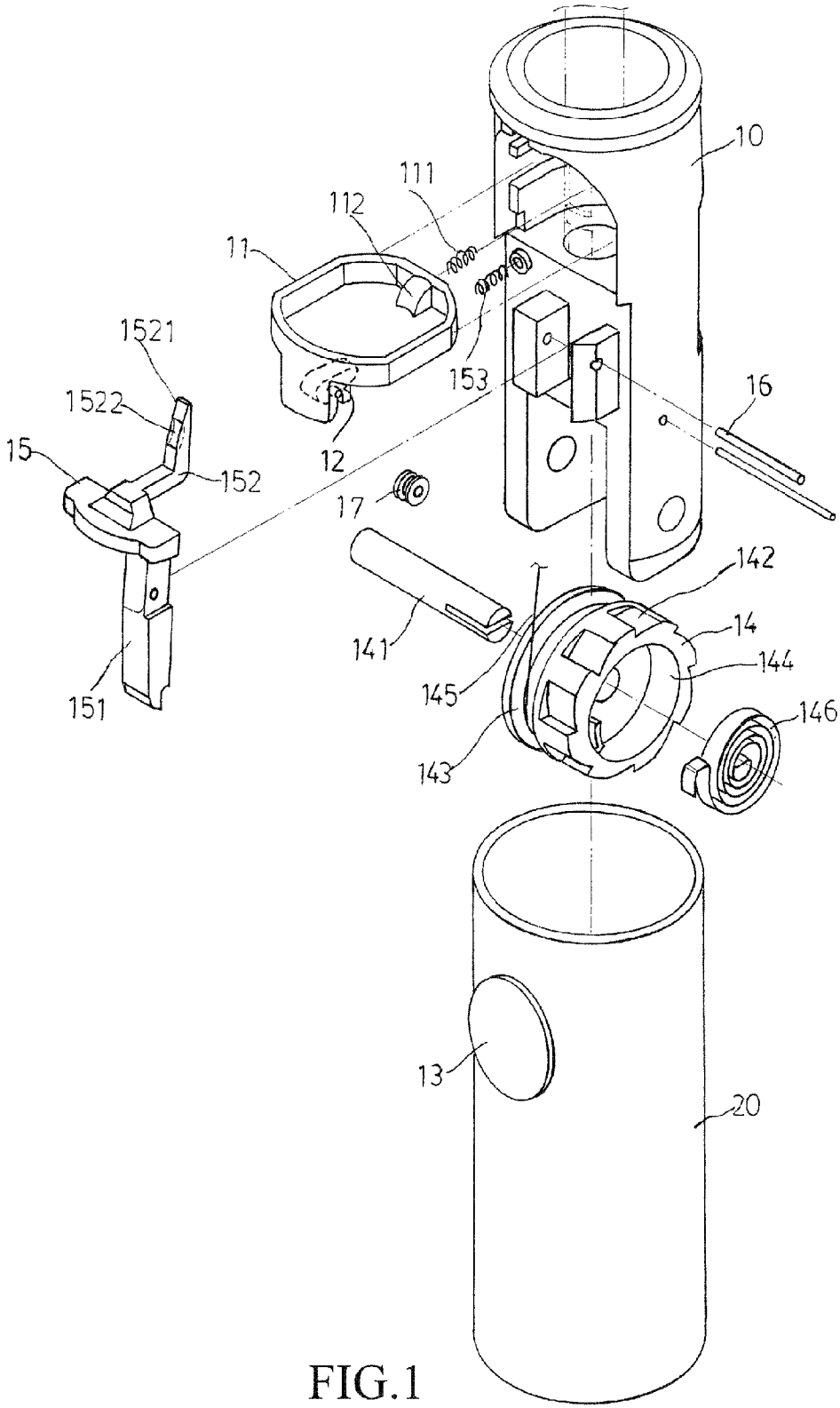
FIG. 1 is an exploded view of a control structure of self-opening/closing umbrella according to the present invention.
Figure 2:
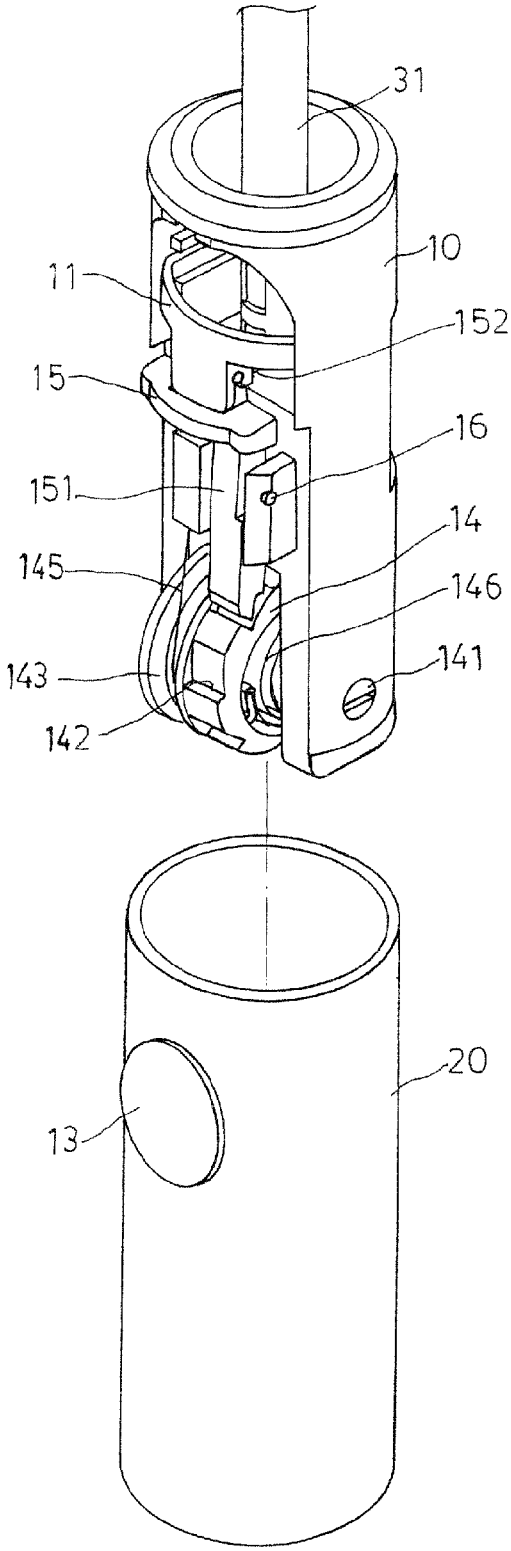
FIG. 2 is a perspective view showing the control structure of self-opening/closing umbrella of the present invention in a partially assembled form.
Figure 3:
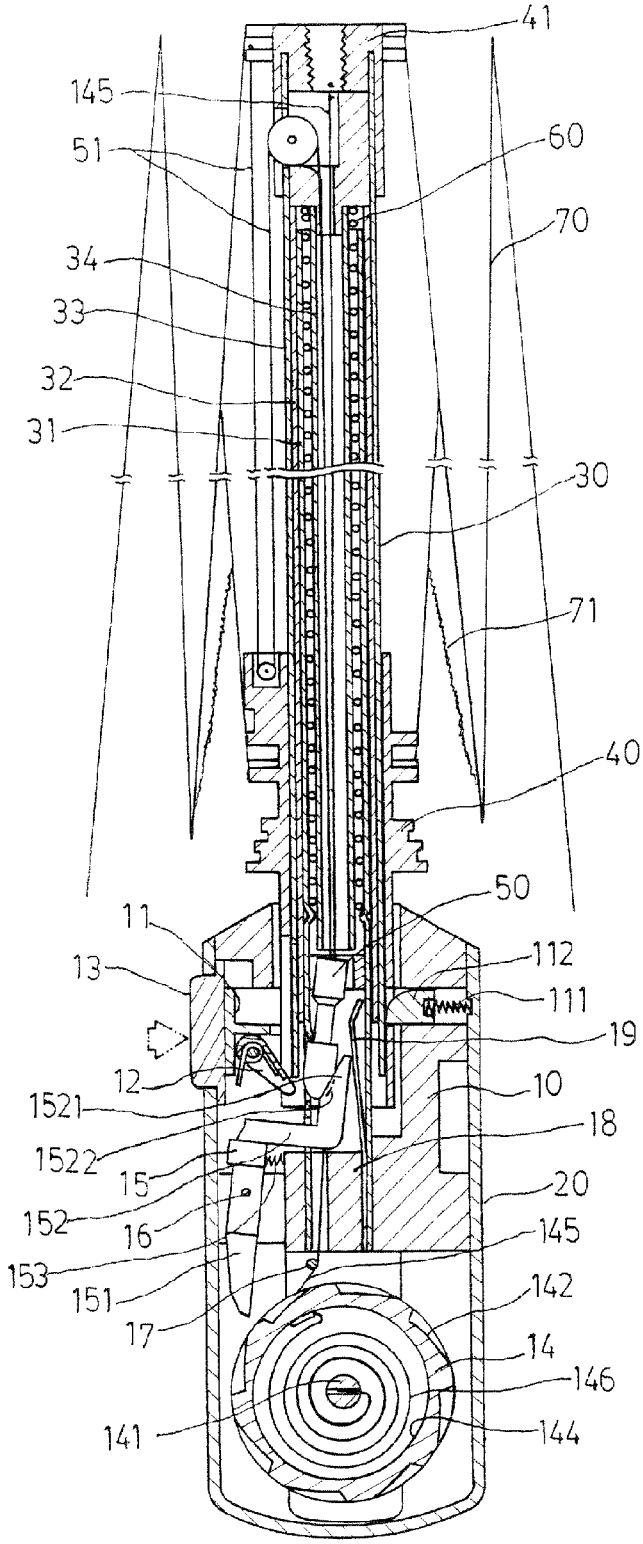
FIG. 3 is a cross-sectional view illustrating the self-opening/closing umbrella of the present invention in a closed condition.

The present invention provides a control structure of self-opening/closing umbrella. As shown in FIGS. 1, 2, and 3, the control structure of the present invention is mounted inside a handle 20 of an umbrella and comprises a main body 10, which is hollow in both an upper portion and a lower portion thereof. The upper hollow portion receives therein a control loop 11 that has a bottom surface on one side of which a control bar 12 is pivotally mounted. A pushbutton 13 is provided at one side of the control loop 11 and a spring 111 is arranged at an opposite side of the control loop 11 to provide a spring force for biasing the control loop 11 toward the pushbutton 13. A tongue 112 is formed inside the control loop 11 at the side opposite to the control bar 12. The lower hollow portion of the main body 10 receives and rotatably supports a reversal prevention wheel 14 with a shaft 141. The reversal prevention wheel 14 has a circumference that includes a first half surface forming a toothed surface 142 and a second half surface forming a rope groove 143 that receives a safety rope 145 that has an end fixed to the rope groove 143 and an opposite end extending through the main body 10 to attach to a crown 41 of the umbrella. The reversal prevention wheel 14 has an end surface forming a circular chamber 144 in which a coil spring 146 is received, whereby an inner end of the coil spring 146 is attached to the shaft 141 and an outer end is fixed to an inside surface of the circular chamber 144. The main body 10 has a central portion that is located above the reversal prevention wheel 14 to rotatably support a locking member 15 with a pin 16. The locking member 15 is loaded by a spring 153. The locking member 15 has a lower portion forming a pawl bar 151 that is located above the rotation space of the toothed surface 142 of the reversal prevention wheel 14 and an upper portion forming an operation bar 152 that has a front section forming a surface-inclined upright portion 1521 and extends through the main body 10 to be located inside a first shaft segment 31 of a central shaft unit 30. The inclined surface of the upright portion 1521 forms a curved recess 1522. Further, a pulley 17 is arranged above the rope groove 143 to guide an upper end of the safety rope 145 to extend upward through the central shaft unit 30 for fixing to the crown 41.

The control structure provided by the present invention is applicable to a self-opening/closing umbrella, which as shown in FIG. 3, is illustrated in the form of a three-fold collapsible umbrella as an embodiment of the present invention, generally comprising the following constituent components including a handle 20 in which the control structure is received, a central shaft unit 30, a runner 40, a bullet-head member 50, an umbrella opening spring 60, and ribs 70. The handle 20 is provided with a pushbutton 13. The central shaft unit 30 is composed of a first shaft segment 31, a second shaft segment 32, and a third shaft segment 33, which are telescopically fit to each other. The first shaft segment 31 has a lower end coupled to the control structure of the handle 20 and receiving therein an elongate tube like lining sleeve 18 that has an upper portion forming a guide surface and a spring plate 19. The third shaft segment 33 has an upper end to which the crown 41 is fixed. The ribs 70 are arranged between the runner 40 and the crown 41. The crown 41 has a lower end to which an inner tube 34 that is received inside the first shaft segment 31 is fixed. The umbrella opening spring 60 is arranged between the first shaft segment 31 and the inner tube 34. The bullet-head member 50 is set below the inner tube 34 and has an upper end to which a pull rope 51 is attached so that the pull rope 51 extends upward through the inner tube 34 and wraps around a pulley set inside the crown 41 and further projects outwards to wrap around a pulley set inside the runner 4 to then have a distal end thereof attached to the crown 41.

FIG. 3 shows the structural arrangement of the self-opening/closing umbrella according to the present invention in a compressed and closed condition, in which the runner 40 is fixed by the tongue 112 of the control loop 11 and at the same time, the control bar 12 is pushed downward by the third shaft segment 33 and becomes inclined. The bullet-head member 50 is pushed downward by the inner tube 34 into the lining sleeve 18 and is guided by the upper-end guide surface of the lining sleeve 18 to push the surface-inclined upright portion 1521 of the operation bar 152 of the locking member 15, whereby the operation bar 152 is driven and rotated toward the spring plate 19 to be acted upon by the spring force of the spring plate 19 to thereby retain the bullet-head member 50 in a retention hole defined in the first shaft segment 31. Under this condition, the pawl bar 151 of the locking member 15 that is rotated as described above is moved away from the rotation space of the toothed surface 142 of the reversal prevention wheel 14 so that the coil spring 146 received in the reversal prevention wheel 14 is in a completely released condition and winds a major portion of the safety rope 145 around the rope groove 143. Further, the curved recess 1522 formed in the inclined surface of the upright portion 1521 provides a secure engagement with the bullet-head member 50 to eliminate undesired sideways shifting when the bullet-head member 50 is pushing the operation bar 152.

Figure 4:
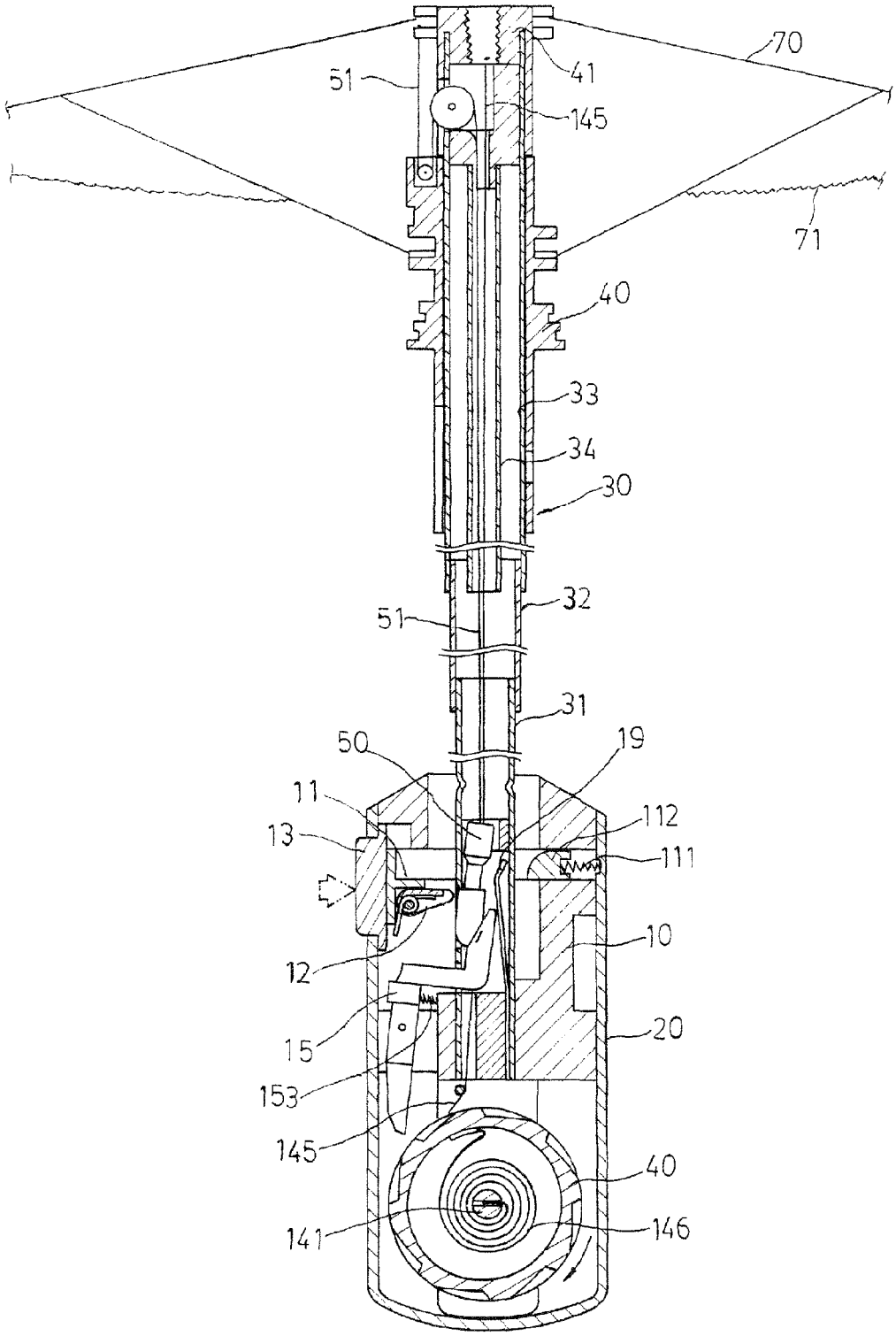
FIG. 4 is a cross-sectional view illustrating the self-opening/closing umbrella of the present invention in an open condition.

Referring to FIG. 3, to open the umbrella, the pushbutton 13 is depressed to move the control loop 11 inward thereby disengaging the tongue 112 from the runner 40. Under the action of the umbrella opening spring 6 arranged inside the central shaft 30, the runner 40 and all the segments of the central shaft unit 3 are driven to extend upward, making the ribs 70 stretched as shown in FIG. 4 to complete the operation of opening umbrella. Under this condition, the control bar 12 returns to the horizontal condition and is in contact with the bullet-head member 50. The safety rope 145 is extended upward with the upward movement of the crown 41 and causes clockwise rotation of the reversal prevention wheel 14, making the coil spring 146 to wind up to a contracted form. At this moment, the locking member 15 makes no action.

Figure 5:
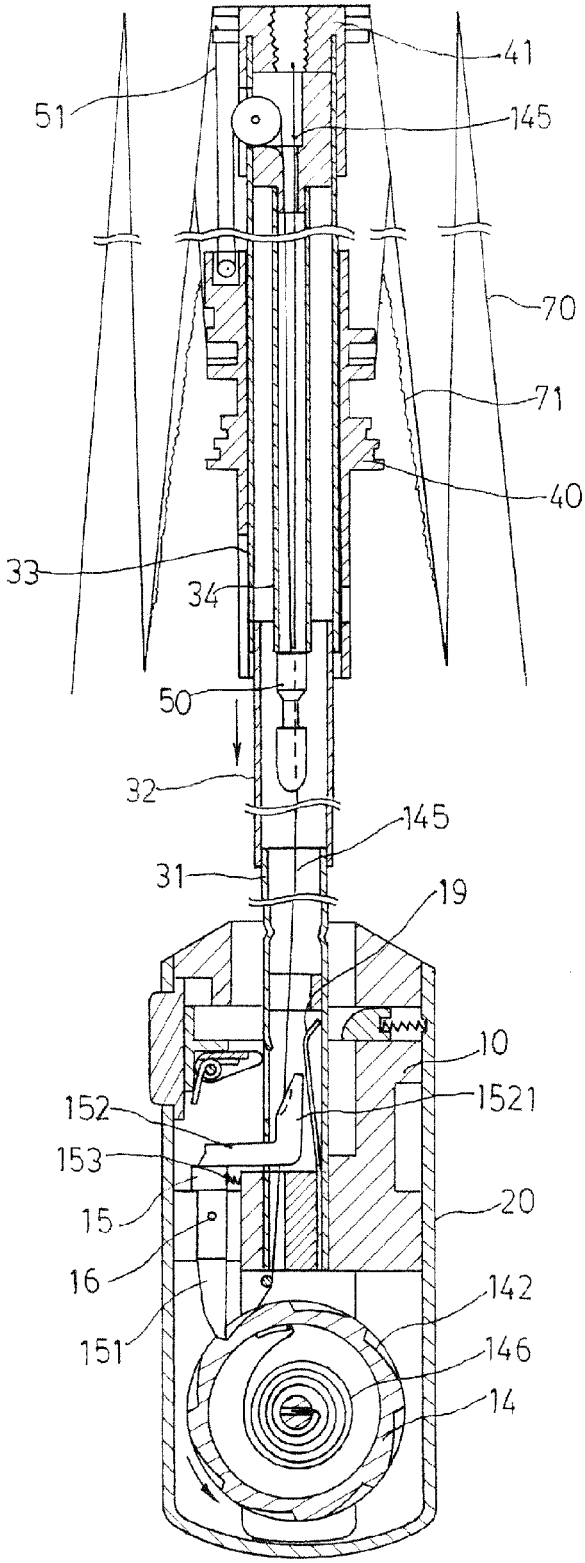
FIG. 5 is a cross-sectional view illustrating collapse of ribs of the umbrella of the present invention in a closing operation.

Referring to FIG. 4, to close the umbrella, the pushbutton 13 is depressed again and by doing so, the control bar 12 pushes the bullet-head member 50 in such a way to disengage the bullet-head member 50 from the retention hole of the first shaft segment 31. As shown in FIG. 5, due to the action of an umbrella closing spring 71 provided in each rib 70, the rib 70 is collapsed and drives the runner 40 downward. The runner 40 that is in the course of downward movement causes the pull rope 51 to move the bullet-head member 50 upward to the lower end of the inner tube 34. Under this condition, the locking member 15 is no longer pushed by the bullet-head member 50 and is biased by the spring 153 to move the pawl bar 151 back to the rotation space of the toothed surface 142 of the reversal prevention wheel 14 to engage the toothed surface 142. Afterwards, the central shaft unit 30 is compressed and when the central shaft unit 30 is acted upon by the external force for compression, the safety rope 145 is released and the reversal prevention wheel 14 is caused by the restoration spring force of the coil spring 146 to rotate counterclockwise, whereby curved back faces of the teeth force the pawl bar 151 to move leftward, but under the action of the spring 153, the pawl bar 151 is immediately returned back into engagement with the toothed surface 142 of the reversal prevention wheel 14. Thus, when the umbrella compression operation is mistakenly in error and undesirably released, the reversal prevention wheel 14 immediately induces reversed rotation and the teeth of the toothed surface 142 is held in position and prevented from rotation by the pawl bar 151 and the safety rope 145 that is mounted to the reversal prevention wheel 14 is held by the crown 41 and thus holds the central shaft unit 30 that is being compressed in position to prevent the central shaft unit 30 from being acted upon by the compressed umbrella opening spring 6 to induce instantaneous spring back. The umbrella shows the condition illustrated in FIG. 3, once the compression for closing the umbrella is completed.

Figure 6:
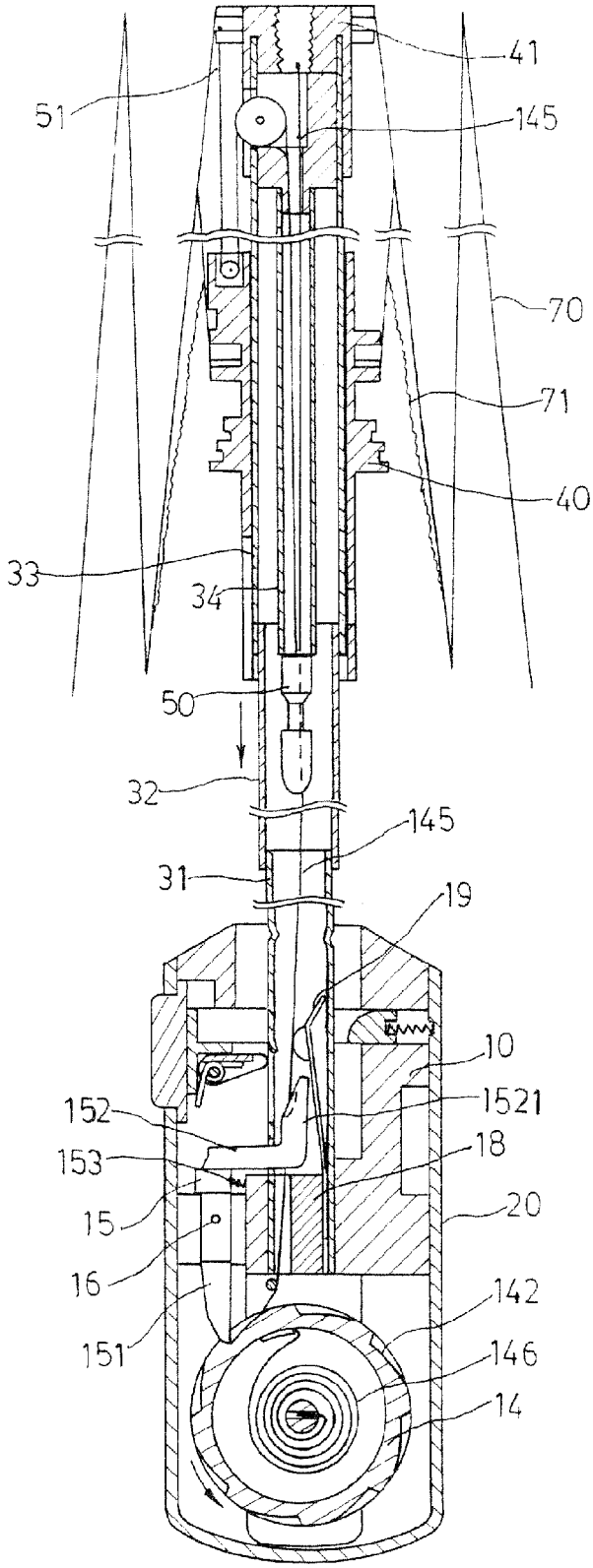
FIG. 6 is a cross-sectional view showing a modified embodiment of the present invention.

FIG. 6 shows a modification of the present invention, wherein the structure of the spring plate 19 of the lining sleeve 18 that is set in the lower portion of the first shaft segment 31 is modified in such a way that the lining sleeve 18 is in the form of a short tube having a lower portion and the spring plate 19 has an upper end having two sides forming guide plate for guiding the bullet-head member 50 to push the surface-inclined upright portion 1521 of the operation bar 152 of the locking member 15 for driving the operation bar 152 to rotate toward the spring plate 19.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A control structure, adapted to be mounted in a handle of a self-opening/closing umbrella and to be coupled to a lower end of a first shaft segment of a central shaft unit of the umbrella, comprising:

a main body;

a control loop in a hollow space in an upper portion of the main body;

a control bar pivotally mounted on a first side of an inner surface of the control loop, wherein the control bar is used to trigger to close the umbrella in an open condition;

a pushbutton withholding the control loop;

a tongue formed on a second side of the inner surface of the control loop, wherein the second side is opposite to the first side, wherein the tongue withholds an inner surface of an opening in a runner of the umbrella when the umbrella is in a closed condition;

a reversal prevention wheel rotatably supported in a hollow space in a lower portion of the main body, the reversal prevention wheel having a circumference that includes a toothed surface;

a rope extending through the main body and having an end fixed to the reversal prevention wheel and an opposite end attached to a crown of the umbrella, wherein the rope has a portion wound around the reversal prevention wheel when the umbrella is in the closed condition;

a locking member rotatably supported in a hollow space in the main body and over the reversal prevention wheel, wherein the locking member has a pawl bar contacting the toothed surface of the reversal prevention wheel when the umbrella is being closed, and an operation bar pressed so as to have the pawl bar kept away from the toothed surface of the reversal prevention wheel when the umbrella is being opened;

a bullet-head member contacting a curved recess at an inclined surface of the operation bar of the locking member when the umbrella is being opened;

a spring plate in the central shaft unit, wherein the spring plate contacts the operation bar of the locking member; and a spring between the pawl bar and the central shaft unit, wherein the spring provides a force to the locking member such that the pawl bar contacts the toothed surface of the reversal prevention wheel when the umbrella is being closed.

2. The control structure according to claim 1 further comprising a shaft rotatably supporting the reversal prevention wheel and a coil spring received in a circular chamber in the reversal prevention wheel, wherein the coil spring has an inner end attached to the shaft and an outer end fixed to an inner surface of the circular chamber.

3. The control structure according to claim 1 further comprising a pulley arranged above the reversal prevention wheel and received in the main body so as to guide the rope to extend upward through the central shaft unit.

* * * * *